US006526596B2

(12) United States Patent
Anderson

(10) Patent No.: US 6,526,596 B2
(45) Date of Patent: Mar. 4, 2003

(54) VINYL HAT

(76) Inventor: Carl Anderson, 129 Toll Gate La., Islamorada, FL (US) 33036

( * ) Notice: Subject to any disclaimer, the term of this patent is extended or adjusted under 35 U.S.C. 154(b) by 0 days.

(21) Appl. No.: 09/847,562

(22) Filed: May 2, 2001

(65) Prior Publication Data

US 2002/0162160 A1 Nov. 7, 2002

(51) Int. Cl.[7] ..... A42B 1/00
(52) U.S. Cl. ..... 2/200.1; 2/175.1
(58) Field of Search ..... 2/181.2, 181.4, 2/183, 175.1, 200.1, DIG. 1, 175.3, 182.2, 182.1

(56) References Cited

U.S. PATENT DOCUMENTS

| | | | | | |
|---|---|---|---|---|---|
| 777,676 | A | | 12/1904 | Jaeger | |
| 1,012,244 | A | | 12/1911 | Cammett | |
| 1,447,602 | A | | 3/1923 | Pierce | |
| 1,673,859 | A | * | 6/1928 | Wittcoff | 2/175.1 |
| 1,999,365 | A | * | 4/1935 | Marienthal | 2/175.1 |
| 2,632,174 | A | | 3/1953 | Lyon | |
| 3,766,565 | A | * | 10/1973 | Cozzens | 2/200 |
| 4,131,953 | A | | 1/1979 | Kimotsuki | |
| 4,292,689 | A | * | 10/1981 | Townsend, Jr. | 2/12 |
| 4,439,871 | A | * | 4/1984 | Plastino | 2/422 |
| 4,793,668 | A | * | 12/1988 | Longstaff | 350/1.1 |
| 4,951,320 | A | | 8/1990 | Yoon | |
| 5,005,220 | A | * | 4/1991 | Gaiatto et al. | 2/421 |
| 5,117,506 | A | * | 6/1992 | Byrnes et al. | 2/10 |
| 5,157,788 | A | * | 10/1992 | Schultz | 2/7 |
| 5,802,617 | A | * | 9/1998 | Boden | 2/183 |
| 5,826,278 | A | * | 10/1998 | King | 2/175.4 |
| 6,154,889 | A | * | 12/2000 | Moore, III et al. | 2/418 |
| 6,182,295 | B1 | * | 2/2001 | Sciglia | 2/200.1 |
| 6,305,028 | B1 | * | 10/2001 | Lin | 2/410 |
| 90 | A | | 11/1836 | Greenleaf | |

* cited by examiner

*Primary Examiner*—John J. Calvert
*Assistant Examiner*—Katherine Moran
(74) *Attorney, Agent, or Firm*—Katten Muchin Zavis Rosenman

(57) ABSTRACT

A wide brim hat is vacuum formed from a thin sheet of specially formulated PVC plastic. The PVC effectively blocks transmission of both WVA and UVB radiation and thereby provides significant protection against the sun. A removable elastic headband centers a wearer's head within the hat and spaces the wearer's head from the crown of the hat. In this manner, cooling air passages are provided between the wearer's head and the interior of the hat crown.

26 Claims, 7 Drawing Sheets

VINYL HAT

BACKGROUND OF THE INVENTION

1. Field of the Invention

The present invention relates in general to molded plastic hats and relates in particular to a hat formed of a particular vinyl material which blocks the transmission of harmful ultraviolet rays.

2. Description of Prior Developments

Attention has been directed to the need for protecting the skin from the harmful effects of sunlight. Dermatologists caution against prolonged skin exposure to ultraviolet light which can cause serious damage to unprotected skin.

In response to this need for protection from the sun, numerous hats have been made available in a wide variety of materials and styles. Although cloth hats absorb some wavelengths of radiation, they are not particularly well suited to absorb ultraviolet radiation. Significantly, large brimmed hats that offer better sun protection are often not worn because they easily blow off in the wind.

Plastic hats are also available but are not particularly well suited for use in intense sunlight and heat. The stiff unyielding structure of conventional plastic hats makes them uncomfortable for use in hot weather. Moreover, because conventional plastic hats are stiff, they do not readily conform to varying head profiles and are prone to being blown away in the wind.

Virtually everyone that has worn a large brimmed hat has experienced wind blowing the hat off. A unique hat clip has been designed to eliminate this problem as described below.

Accordingly, a need exists for a plastic hat which blocks harmful ultraviolet rays yet which is comfortable to wear in hot weather. A further need exists for such a hat which readily accommodates various head sizes while providing adequate ventilation to promote cooling air flow within the hat.

SUMMARY OF THE INVENTION

The present invention has been developed to fulfill the needs noted above and therefore has as an object the provision of a plastic hat which is molded from a specific vinyl composition which effectively blocks the transmission of ultraviolet light.

Another object of the invention is the provision of a vinyl plastic hat which is soft and pliable, and which accommodates varying head sizes.

Another object of the invention is the provision of a vinyl plastic thermoformed hat which provides significant air cooling openings into the crown of the hat to prevent sweating.

Still another object of the invention is the provision of a vinyl hat which tightly grips a wearer's head and resists being blown off by wind.

Another object of the invention is to provide a vinyl hat with a downwardly sloping front brim for deflecting wind and further preventing the hat from being blown off a wearer's head.

Another object of the invention is to provide a large brim hat having a positive anti-blow-off capability in brisk wind.

These and other objects are met in accordance with the present invention which is directed to a vinyl hat which is formed of a specific vinyl plastic composition which effectively blocks the transmission of ultraviolet sun rays. With a material thickness as low as 0.012 inch, ultraviolet rays can be completely blocked The vinyl hat not only blocks UV rays, but is also designed to stay on one's head even in high winds. Moreover, by using a thin sheet of vacuum-formed vinyl, the resulting molded hat maintains its shape, yet is easily deformed and pliable.

A specially designed internal headband elastically conforms to different head sizes while snugly retaining the hat on a wearer's head. The headband is spaced apart from the interior crown walls to provide cooling air passages between the hat and a wearer's head.

The elastic headband is removably mounted within the crown of the hat with removable plastic clips. These clips are placed outside of the crown, over four slots, and can be arranged in an interweaving manner with an elastic band which is pulled through the slots. A layer of anti-glare material is applied to the underside of the hat brim to reduce sun glare and enhance the wearer's vision.

The aforementioned objects, features and advantages of the invention will in part, be pointed out with particularity, and will, in part, become obvious from the following more detailed description of the invention, taken in conjunction with the accompanying drawings which form an integral part thereof.

BRIEF DESCRIPTION OF THE DRAWINGS

In the drawings.

In the various figures of the drawings, like reference characters designate like or similar parts.

DETAILED DESCRIPTION OF THE PREFERRED EMBODIMENTS

The present invention will now be described in conjunction with the drawings, beginning with FIG. 1, which shows a hat 10 constructed in accordance with the invention. Hat 10 can be worn for any occasion, but is particularly adapted for use in outdoor activities such as fishing, hiking, camping, and any other activity where exposure to the sun is involved.

Hat 10 is preferably formed of a plastic material such as molded vinyl. A particularly effective material has been found to be a vinyl material of the type disclosed in U.S. Pat. No. 5,551,210, which is incorporated herein by reference. The polyvinyl chloride (PVC) disclosed in U.S. Pat. No. 5,551,201 is preferred for forming hat 10 because of its unique properties.

That is, the PVC material of U.S. Pat. No. 5,551,201 may be readily adapted in sheet form for molding hat 10 using a thermoforming process such as vacuum forming. While the thickness of the PVC sheet is typically about 0.020 inch, it may be as thin as about 0.012 inch and yet still produce a hat 10 which maintains its shape and completely blocks harmful ultraviolet light including both ambient UVA and UVB radiation. Hat 10 formed of the PVC material of U.S. Pat. No. 5,551,201 retains its shape, yet is bendable and pliable as opposed to conventional molded plastic hats which are stiff and crack and break upon bending.

Figure 2:
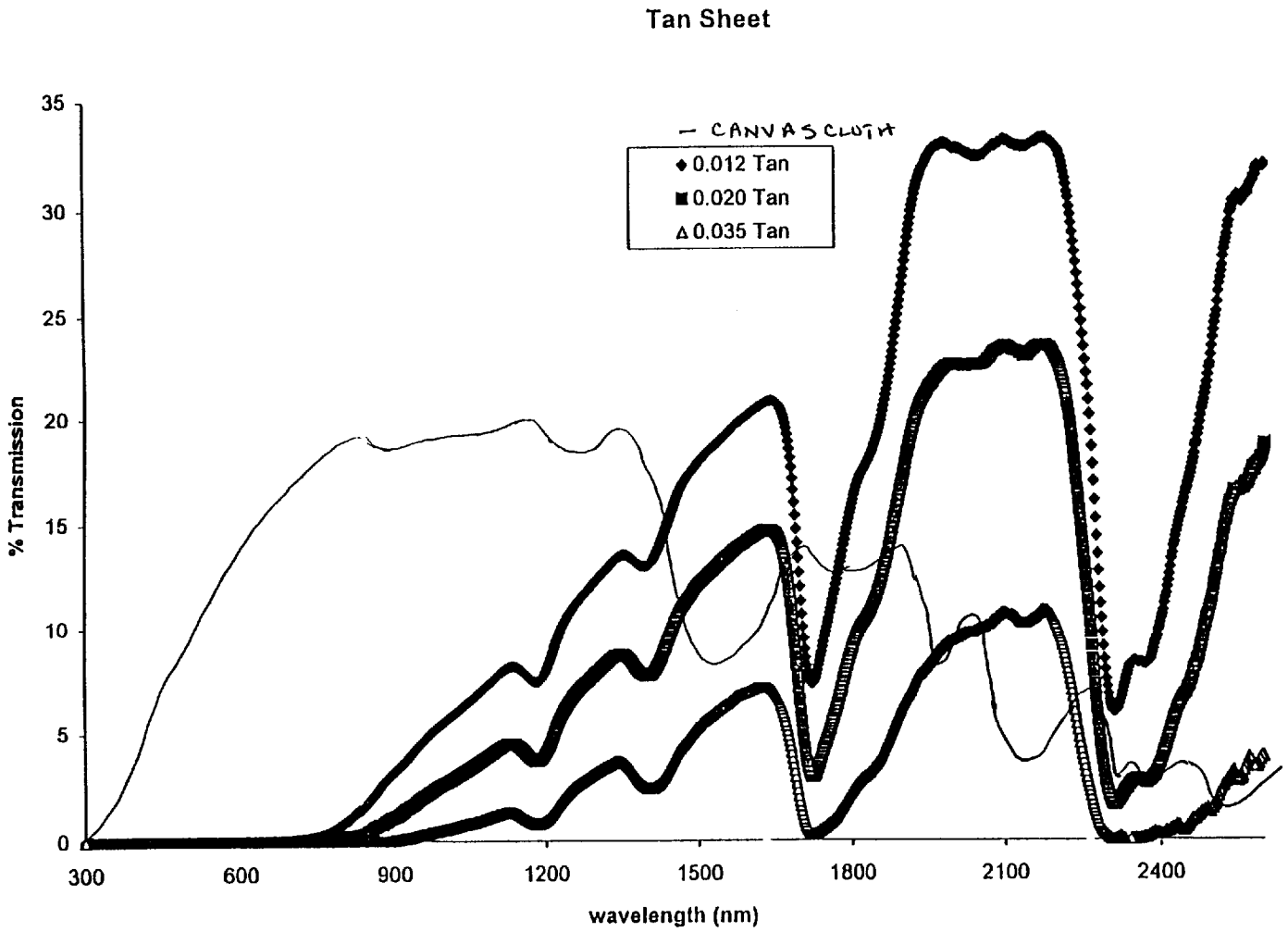
FIG. 2 is a plot of light transmission through three different thicknesses of PVC material used for producing the hat of FIG. 1, plotted as a function of wavelength and comparing the transmission plots with a transmission plot of a canvas material.

As seen in FIG. 2, three different thickness of the PVC material of U.S. Pat. No. 5,551,201 are compared with canvas cloth material with respect to the transmission of light over a broad range of wavelengths. The wavelength of the UV region which includes UVA and UVB light extends from about 300 nm to about 400 nm. Visible light extends over a wavelength range of about 400 to 700 nm, near infrared extends over about 700 nm to 1700 nm and for infrared from about 1700 nm to about 2600 nm.

As seen in FIG. 2, the PVC material preferred for hat 10 effectively blocks all ambient light transmission from about 300 nm to about 850 nm, indicating that the preferred sheet stock PVC material with a thickness as low as 0.012 inch is completely resistant to the transmission of light in the UV region. This provides significant benefits in terms of protecting the skin against the harmful effects of UV light.

By comparison, as seen in FIG. 2, canvas material of the type commonly used to produce outdoor sporting hats allows significant levels of UV light transmission throughout substantially the entire UV range. Accordingly, the PVC material of U.S. Pat. No. 5,551,201 is preferred over canvas with respect to UV protection, as well as over other PVC materials with higher transmissions of UV light. An important feature of the PVC material of U.S. Pat. No. 5,551,201 is the presence of a UV inhibitor which protects the PVC against deterioration from sunlight.

A preferred form of PVC material is dyed a light tan color and formed from sheet stock about 0.020 inch thick. The outer surface of the sheet which forms the outer surface of hat 10 can be formed with a textured semi-gloss grained finish which eliminates any "plastic" look and which reflects up to 90% of the sunlight and accompanying heat which would otherwise strike the wearer. Hat 10 maintains a clean and crisp "new" look even after many washings as compared to other hats which become worn looking after only one or two washings.

Figure 1:
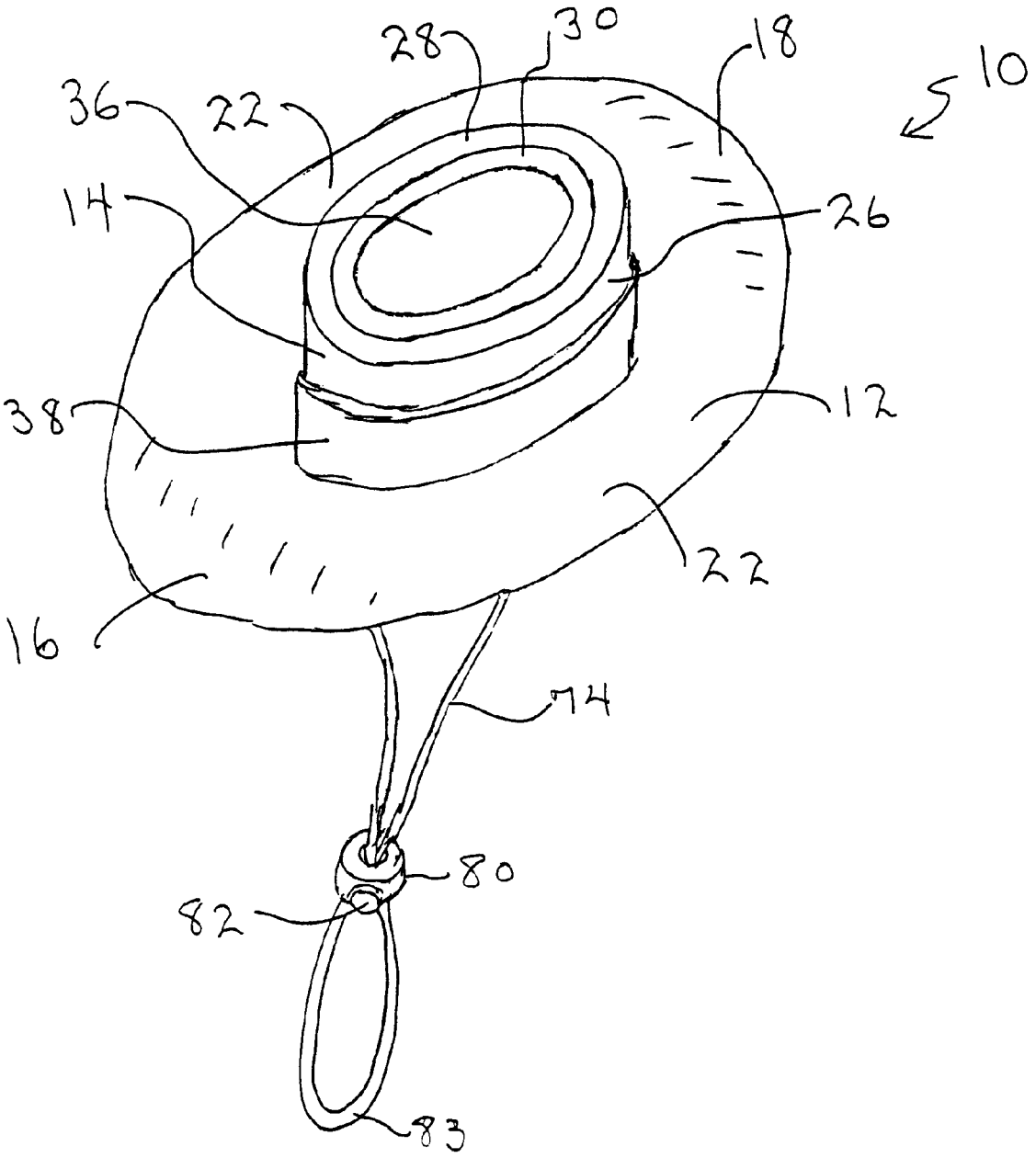
FIG. 1 is a perspective view of a vinyl hat constructed in accordance with the invention.

As further seen in FIG. 1, hat 10 includes a brim 12 and a crown 14. Brim 12, in one embodiment, is about 3.5 inches wide and is formed with a downwardly sloping leading edge 16 and a similarly downwardly sloping trailing edge 18. These downwardly sloping brim portions 16, 18 not only add to the aesthetic appearance of hat 10, they also help to block sunlight from a wearer's face and neck.

Another advantage of the downwardly angled surfaces of brim portions 16, 18 is the enhanced accommodation of wind. That is, brim portions 16, 18 help to prevent wind from getting underneath brim 12 and blowing hat 10 off a wearer's head.

Brim portions 16, 18 direct wind over the top of brim 12 rather than beneath it. They can slope downwardly from the crown 14 at an angle or arc of about 20° to 50° and preferably around 40°. Brim portions 16, 18 have been found effective in preventing hat 10 from being blown off a wearer's head in winds up to 25 miles per hour.

Figure 3:
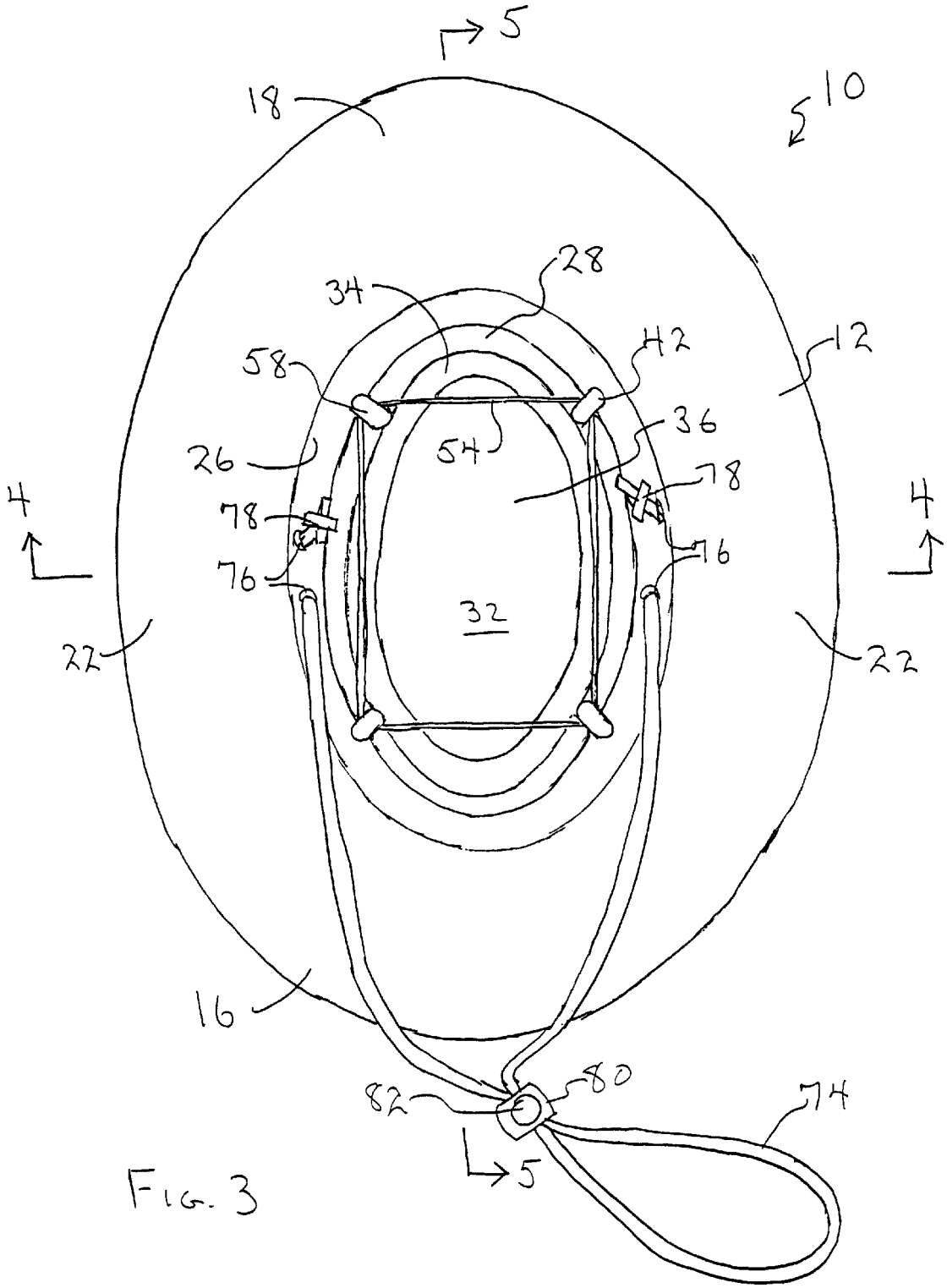
FIG. 3 is a bottom view of FIG. 1.
Figure 4:
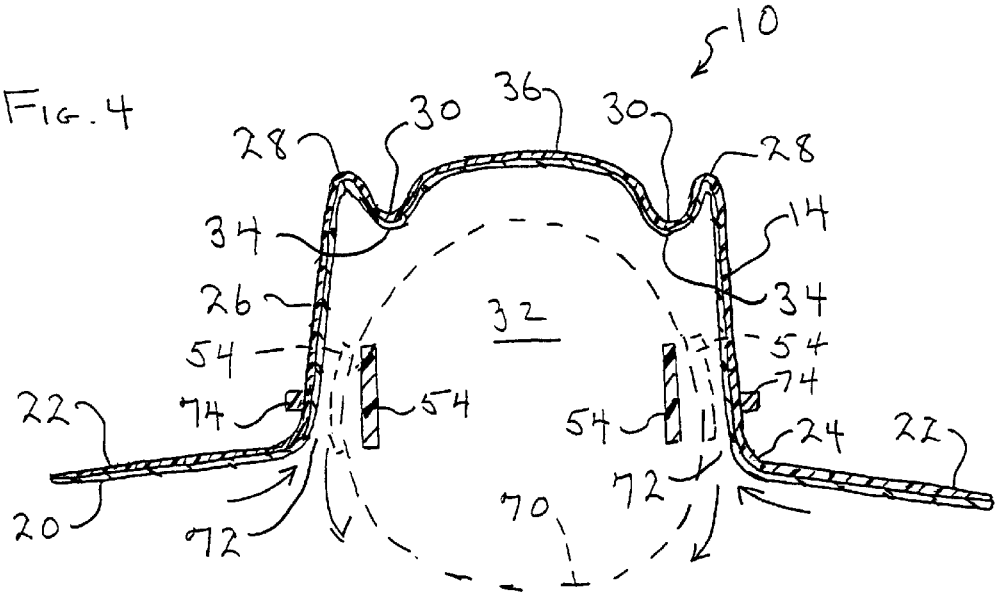
FIG. 4 is a view in section taken along line 4—4 of FIG. 3.
Figure 5:
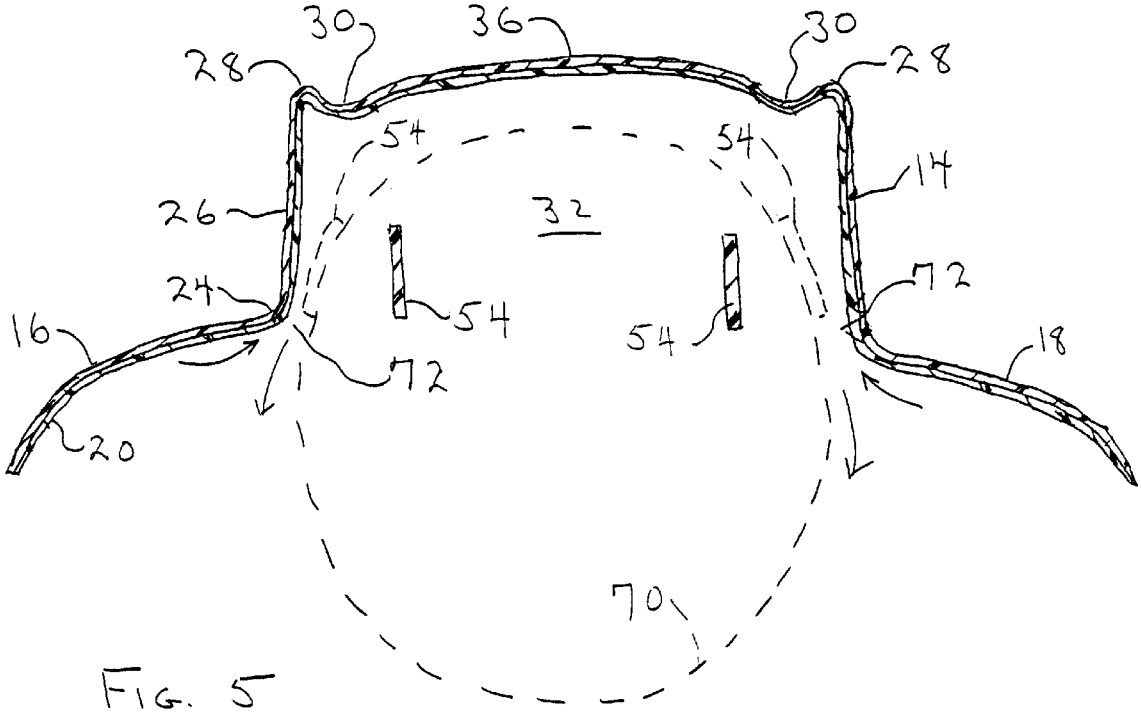
FIG. 5 is a view in section taken along line 5—5 of FIG. 3.

Although brim 12 provides significant reduction of sunlight glare, the undersurface of at least brim 12 can be coated with a glare resistant material 20, as shown in FIGS. 3, 4 and 5. Material 20 can, in one embodiment, be a thin coating of a dull, dark green paint which absorbs light reflected upwardly from surfaces such as water, sand and snow, and thereby prevents the reflected light from reaching a wearer's face and eyes.

It is also possible to paint or otherwise provide a pattern design, logo or text on either the external or internal surface of hat 10 or both surfaces of hat 10. For example, a camouflage pattern can be painted or silk screened on the exterior, upper or outer surfaces of hat 10, as well as on the lower or interior surface of hat 10.

As best seen in FIGS. 1, and 4–6, brim 12 includes a pair of generally flat side portions 22 which separate the front and rear brim portions 16, 18. Brim 12 joins crown 14 along a curved, oval-shaped border 24. Crown 14 includes an inwardly tapering tubular side wall 26 having an annular, substantially oval periphery.

Side wall 26 extends upwardly and terminates in an upwardly arched oval ridge 28. Ridge 28 surrounds and extends downwardly and inwardly into a U-shaped oval trough 30 which borders ridge 28. Trough 30 projects downwardly into the interior 32 of crown 14 to form a corresponding downwardly arched ridge 34.

Trough 30 borders an oval-shaped arched roof or dome portion 36 which projects upwardly slightly above ridge 28. The contiguous ridges 28, 34 provide strength and rigidity to the hat crown 14.

As seen in FIG. 1, hat 10 includes an annular hatband 38 which surrounds crown 14 adjacent border 24. Hatband 38 may be formed of cloth or similar fabric and may include designs, logos and/or text. The hatband 38 is held in place with double-sided foamed tape pads 40, shown in FIG. 6.

Figure 7:
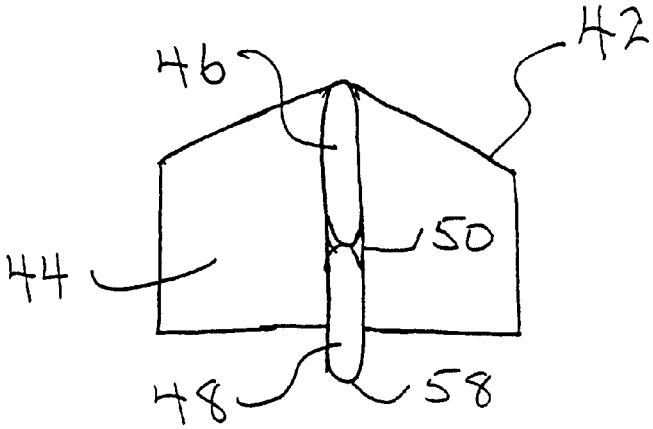
FIG. 7 is an interior side view of the clip of FIG. 6.
Figure 8:
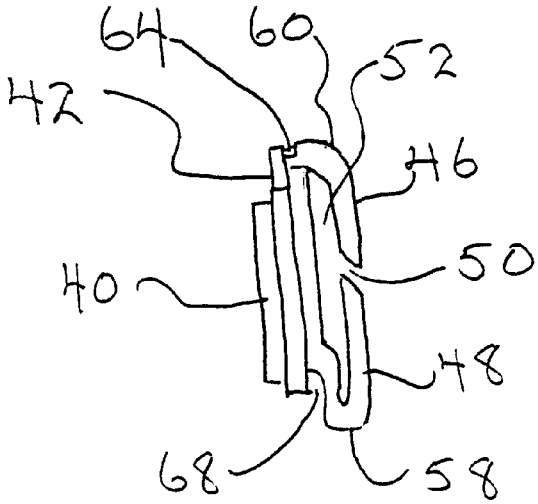
FIG. 8 is a left side view of FIG. 7.

Pads 40 may be applied directly to crown 14 or, preferably, to the exterior flat surface of one or more plastic clips 42. As seen in FIGS. 7 and 8, each clip 42 includes a flat base 44 and a pair of resilient hook-shaped clip arms 46, 48 which are cantilevered outwardly from base 44.

The free ends of the clip arms oppose one another and define between them an angled opening or mouth 50. Mouth 50 leads into an open vertical slot 52 which receives an elastic headband 54, as discussed below.

Figure 6:
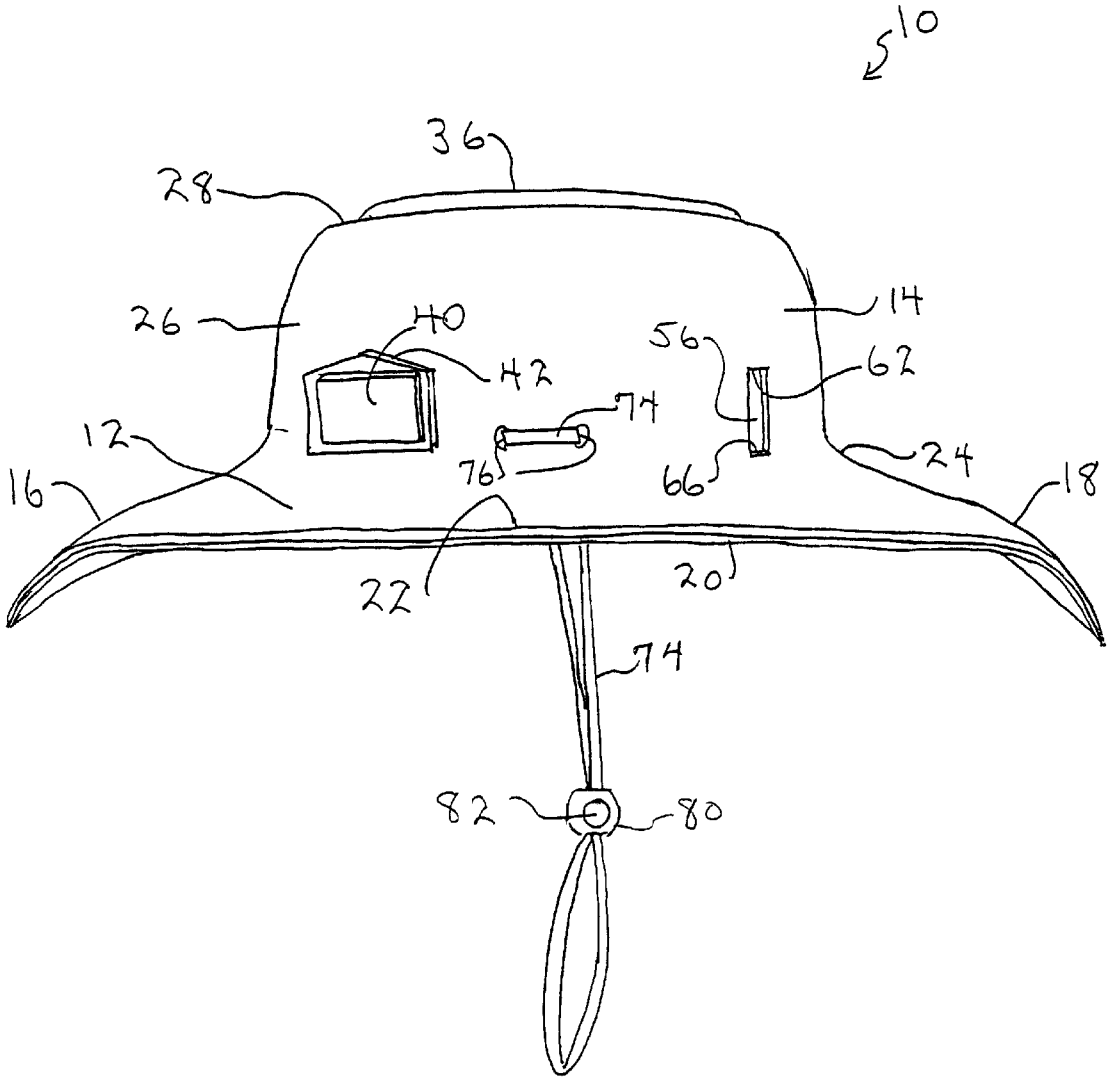
FIG. 6 is a side view of FIG. 1, with the hatband and one clip removed for clarity.

Several clips 42 are used to hold headband 54 in place. As seen in FIG. 3, four clips 42 are arranged in a rectangular pattern around side wall 26 of crown 14. As seen in FIG. 6, rectangular slots 56 are punched or otherwise formed through the side wall 26 for resiliently receiving the clip arms 42 with a snap-fit connection. The clip arms are configured to extend further apart than the length of slot 56 so as to provide for a slight interference fit within the slot 56.

As seen in FIG. 8, each lower clip arm 48 has a downwardly extending elbow 58 which is initially inserted into the bottom of a respective slot 56. The clip 42 is then pushed and pivoted into the slot 56 with the rounded corner 60 of the upper arm 46 camming its way into the slot against the upper wall 62 (FIG. 6) of slot 56.

When the upper arm 46 clears the slot 56, the upper wall 62 snaps into groove 64 to secure the clip 42 within the slot 56. The lower wall 66 of slot 56 is likewise locked into groove 68 (FIG. 8) formed adjacent the lower clip arm 48. Clip 42 can be snapped out of slot 56, if desired.

As seen in FIG. 3, the elastic headband 54 is held in a stretched rectangular shape within the interior 32 of crown 14 by four clips 42. The headband 54 is removably mounted within each respective clip slot 52 by sliding the headband 54 through each respective clip mouth 50 and into slot 52.

The headband 54 may be likewise removed from the clips 42 through clip mouths 50 for cleaning or replacement.

In one embodiment, headband 54 is about 21 inches in length when stretched through the four clips 42. This length provides a rectangular support which readily accommodates many different head shapes and sizes for a "one size fits all" hat design.

As seen in FIGS. 4 and 5, a human head 70 is shown schematically in dashed lines and fitted with hat 10. It can be appreciated that the elastic headband 54 shown in solid lines stretches laterally to the positions shown in dashed lines.

An important feature of the invention is the provision of annular cooling air passages 72 which surround a wearer's head 70 (FIGS. 4 and 5). Air flows into and out of the interior 32 of crown 14 between the side wall 26, headband 54 and head 70 as represented by the directional arrows in FIGS. 4 and 5. It is the elastic headband which spaces head 70 from side walls 26 and centers the wearer's head within crown 14 thereby ensuring the presence of passages 72.

The hat 10 may include a chin strap 74 for preventing the hat from blowing away in high winds. Strap 74 may take the form of a leather cord having opposite ends threaded into a pair of spaced apart holes 76 formed in each lateral side portion of side wall 26. A simple knot 78 can be used to anchor the chin strap 74 to hat 10.

A conventional sliding barrel clamp 80 is provided to adjustably cinch the chin strap to a wearer's chin. Clamp 80 includes a spring-loaded release clamp 82 for releasing the clamp barrel for sliding adjustment. When high winds are experienced, the sliding barrel is snugged up beneath a user's chin and the end loop 83 (FIG. 9) of the chin strap is placed over a strap retainer 84 that is installed on top of the brim. The tension applied to the front of the brim by the strap tensioned on the strap retainer can bend the brim slightly further downwardly to even further resist wind getting under the brim.

There has been disclosed heretofore the best embodiment of the invention presently contemplated. However, it is to be understood that various changes and modifications may be made thereto without departing from the spirit of the invention. For example, as further seen in FIG. 9, the chin strap 74 can be held on the crown 14 with a knot 86 which lies externally on the side wall 26. Only a single hole 76 in side wall 26 is required for this embodiment. End loop 83 is looped over post 84 which may be a simple double headed rivet crimped to the leading edge 16 of brim 12.

Figure 9:
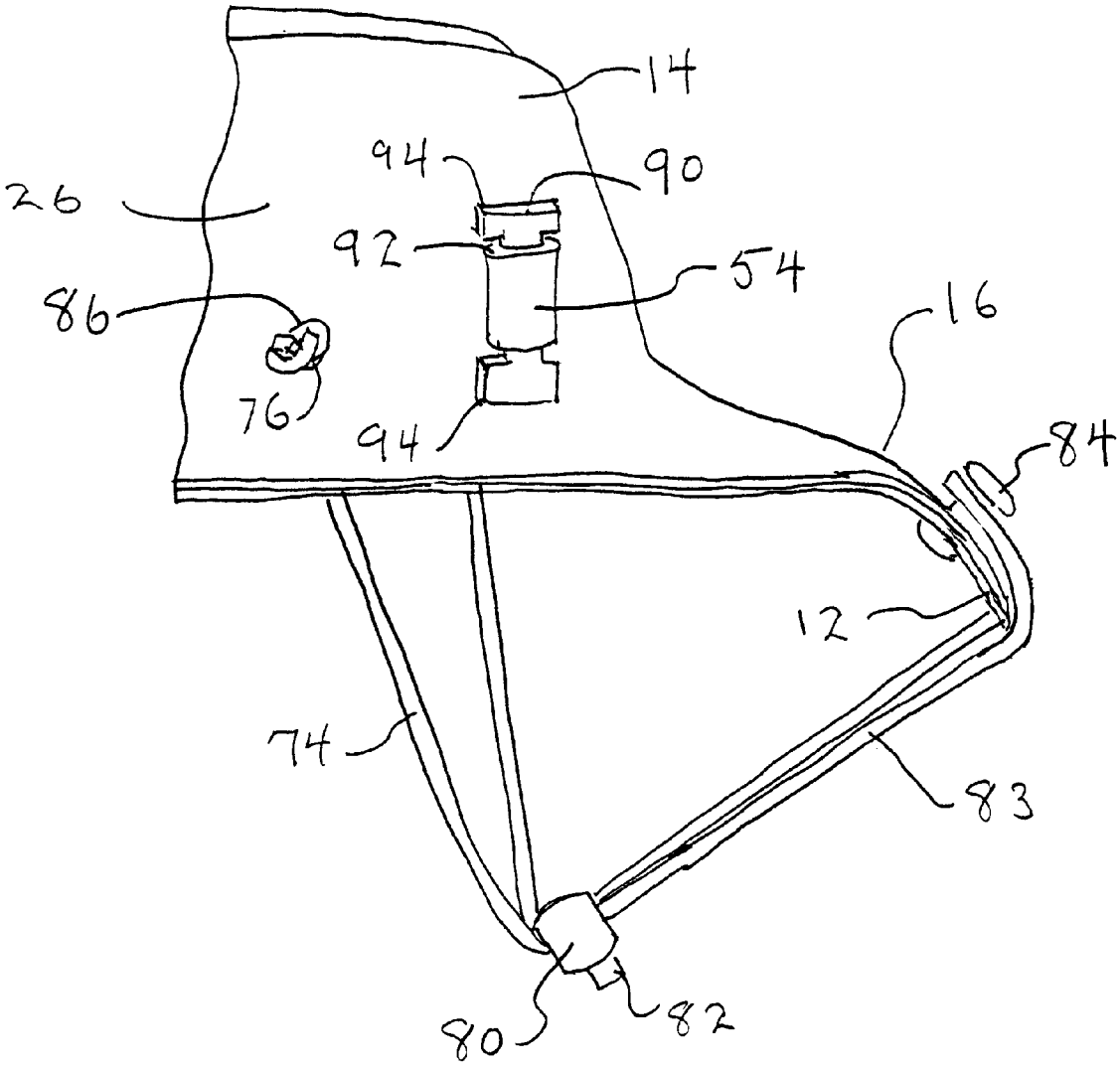
FIG. 9 is a partial side view, similar to FIG. 6, showing alternate embodiments of the invention.

A simplified arrangement for holding the headband 54 in place is further shown in FIG. 9. In this embodiment, a flat I-shaped retainer clip 90, formed of plastic or other suitably strong material, is inserted through each loop 92 formed in head band 54. Each loop 92 is pulled through each slot 56 (FIG. 6) and extended sufficiently outwardly to allow a retainer 90 to be inserted through the loop.

Once the retainer 90 is inserted through a loop 92, the headband 54 is released and the loop 92 is pulled inwardly by the elastically stretched headband. This inward pulling of headband 54 elastically seats and holds the retainer against the exterior surface of side wall 26. The projecting ends 94 of the retainer 90 prevent the headband 54 from dislodging from the retainer.

What is claimed is:

1. A hat formed of a sheet of vinyl plastic, and comprising:

a crown;

a brim surrounding said crown; and wherein said vinyl plastic comprises polyvinyl chloride (PVC) and said sheer has a thickness sufficient to block transmission of substantially all UV light, and wherein said hat blocks transmission of substantially all ambient radiation having a wavelength from about 300 nm to about 850 nm.

2. The hat of claim 1, wherein said sheet comprises a UV inhibitor.

3. The hat of claim 1, wherein said sheet comprises a thickness of about 0.020 inch.

4. The hat of claim 1, wherein said crown and said brim are formed from said sheet by vacuum forming.

5. The hat of claim 1, wherein said crown and said brim are formed with a textured exterior surface.

6. The hat of claim 1, further comprising an anti-glare material provided on said brim.

7. The hat of claim 6, wherein said anti-glare material comprises a paint applied over an interior surface of said brim.

8. A hat formed of a plastic material, and comprising:

a crown;

a laterally extending brim surrounding said crown;

a plurality of retainers mounted externally around said crown; and an elastic headband mounted within an interior portion of said crown and supported by said retainers.

9. The hat of claim 8, wherein said plastic comprises a sheet of PVC.

10. The hat of claim 8, wherein said crown comprises a side wall having a plurality of slots formed therein and wherein said plurality of retainers respectively overlie said plurality of slots.

11. The hat of claim 8, wherein said headband is spaced apart from said crown by said retainers.

12. The hat of claim 8, wherein said headband is removably mounted to said retainers.

13. The hat of claim 8, wherein said plurality of retainers is arranged in a rectangular pattern.

14. The hat of claim 8, further comprising a harband surrounding said crown and covering said retainers.

15. The hat of claim 8, further comprising a chin strap secured to said hat and a retainer post mounted on said brim for retaining said chin strap.

16. The hat of claim 15, wherein said retainer comprises a rivet.

17. The hat of claim 8, wherein said retainers are snap fit to said crown.

18. The hat of claim 8, further comprising an oval ridge and an oval groove each formed on a top portion of said hat.

19. The hat of claim 8, wherein said crown and said headband define an air cooling passage therebetween.

20. A hat formed of a sheet of vinyl plastic, and comprising:

a crown;

a brim surrounding said crown; and wherein said vinyl plastic consists solely of polyvinyl chloride and said sheet has a thickness sufficient to block transmission of substantially all UV light.

21. The hat of claim 20, wherein said sheet comprises a UV inhibitor.

22. The hat of claim 21, wherein said sheet comprises a thickness of about 0.020 inch.

23. A hat formed of a sheet of vinyl plastic, and comprising:

a crown; and a brim surrounding said crown;

wherein said vinyl plastic comprises polyvinyl chloride and said sheet has a thickness sufficient to block transmission for substantially all UV light; and wherein said crown and said brim are simultaneously formed from said sheet by vacuum forming.

24. The hat of claim 23, wherein said crown and said brim are formed with a textured exterior surface.

25. A hat formed of a sheet of vinyl plastic, and comprising:

a crown; and a brim surrounding said crown;

wherein said vinyl plastic comprises polyvinyl chloride and said sheet has a thickness sufficient to block transmission for substantially al UV light; and further comprising an anti-glare material provided on an interior surface of said brim.

26. The hat of claim 25, wherein said anti-glare material comprises a paint applied over said interior surface of said brim.

* * * * *